US009848746B2

(12) United States Patent
Feng

(10) Patent No.: US 9,848,746 B2
(45) Date of Patent: Dec. 26, 2017

(54) VACUUM CLEANER AND SUCTION NOZZLE THEREOF

(75) Inventor: Yongbing Feng, Suzhou (CN)

(73) Assignee: ECOVACS ROBOTICS CO., LTD., Suzhou (CN)

( * ) Notice: Subject to any disclaimer, the term of this patent is extended or adjusted under 35 U.S.C. 154(b) by 801 days.

(21) Appl. No.: 13/979,073

(22) PCT Filed: Dec. 27, 2011

(86) PCT No.: PCT/CN2011/084730

§ 371 (c)(1),
(2), (4) Date: Jul. 10, 2013

(87) PCT Pub. No.: WO2012/094943

PCT Pub. Date: Jul. 19, 2012

(65) Prior Publication Data

US 2013/0276263 A1 Oct. 24, 2013

(30) Foreign Application Priority Data

Jan. 14, 2011 (CN) ..... 2011 1 0023709

(51) Int. Cl.
*A47L 5/10* (2006.01)
*A47L 5/26* (2006.01)
(Continued)

(52) U.S. Cl.
CPC ..... *A47L 9/0466* (2013.01); *A47L 9/04* (2013.01); *A47L 9/0427* (2013.01);
(Continued)

(58) Field of Classification Search
CPC ..... A47L 9/0477; A47L 9/0466; A47L 9/0455
(Continued)

(56) References Cited

U.S. PATENT DOCUMENTS 1,395,500 A * 11/1921 Kirby ..... A47L 9/0422 15/392
1,740,525 A * 12/1929 Tyson ..... A47L 9/0477 15/364

(Continued)

FOREIGN PATENT DOCUMENTS

CN 1768674 A 5/2006
CN 201958790 U 9/2011

(Continued)

OTHER PUBLICATIONS

International Search Report dated Mar. 29, 2012 in corresponding International Application No. PCT/CN2011/084730.

(Continued)

*Primary Examiner* — Bryan R Muller

(57) ABSTRACT

A vacuum cleaner and suction nozzle thereof. The vacuum cleaner has a housing, dust collecting unit, filter assembly, motor assembly and roller brush. The suction nozzle has a bottom housing, front cover and roller brush. The housing includes a concave cavity; the bottom housing and the front cover latch together to form a chamber; the roller brush assembly and the separation piece fit into this chamber; the separation piece corresponds to a transmission component of the roller brush. When rotating at high speed, the roller brush forms a seamless and closed separation face with the separation piece, preventing foreign matter from entering the transmission component, thus avoiding reduced suction and damage due to a tangled synchronous belt or a shaft jamming a roller brush bearing.

15 Claims, 8 Drawing Sheets

(51) Int. Cl.
*A47L 9/04* (2006.01)
*A47L 9/06* (2006.01)
*A47L 9/12* (2006.01)

(52) U.S. Cl.
CPC ..... *A47L 9/0444* (2013.01); *A47L 9/0455* (2013.01); *A47L 9/0477* (2013.01); *A47L 9/12* (2013.01)

(58) Field of Classification Search
USPC ..... 15/362–392
See application file for complete search history.

(56) References Cited

U.S. PATENT DOCUMENTS 3,646,629 A * 3/1972 Bienek ..... A47L 11/33 15/48
4,802,254 A * 2/1989 Lahndorff ..... A47L 9/04 15/179
4,854,006 A * 8/1989 Nishimura ..... A47L 9/0455 15/375
6,237,189 B1 * 5/2001 Maurer ..... A47L 5/30 15/383
6,799,351 B2 * 10/2004 Porath ..... A47L 9/02 15/325
7,418,764 B2 * 9/2008 Gordon ..... A47L 5/34 15/354
7,716,784 B2 * 5/2010 Yang ..... A47L 9/0422 15/383
7,941,893 B2 * 5/2011 Worwag ..... A47L 9/0072 15/319
2006/0150365 A1 * 7/2006 Ivarsson ..... A47L 9/0411 15/388
2006/0185119 A1 8/2006 Kim et al.
2006/0248680 A1 * 11/2006 Heidenga ..... A47L 9/04 15/387
2008/0053479 A1 * 3/2008 Worwag ..... A47L 9/0072 134/6
2008/0244852 A1 * 10/2008 Alton ..... A46B 13/001 15/179
2011/0099751 A1 * 5/2011 Conrad ..... A47L 7/02 15/387

FOREIGN PATENT DOCUMENTS

GB 2214416 A * 9/1989 ..... A47L 9/0411
JP 3969490 9/2007
JP 2008-200308 9/2008
WO WO 2004/052166 A1 6/2004

OTHER PUBLICATIONS

Extended European Search Report dated Jun. 29, 2017 in corresponding European Patent Application No. 11855801.4.

* cited by examiner

VACUUM CLEANER AND SUCTION NOZZLE THEREOF

CROSS-REFERENCE TO RELATED APPLICATIONS

This application is a U.S. national stage application under 35 U.S.C. 371 of PCT/CN2011/084730 filed Dec. 27, 2011 and claims foreign priority benefit of Chinese Application No. 201110023709.X filed Jan. 14, 2011 in the Chinese Intellectual Property Office, the contents of both of which are incorporated herein by reference.

FIELD OF THE INVENTION

The present invention relates to a cleaner, in particular relates to a vacuum cleaner and suction nozzle thereof.

BACKGROUND OF THE INVENTION

A cleaner available nowadays generally includes a dust barrel, a filter assembly and a motor assembly which are all located within a housing, and the motor assembly is communicated with the dust barrel through the filter assembly. The motor assembly includes a motor and a fan, and blades of the fan have a certain angle, so that the blades look like airplane propellers. The motor drives the fan blades to operate at a high speed when it is powered on, such that vacuum state is instantly formed inside the cleaner, and air pressure inside the vacuum cleaner is significantly lower than the pressure outside. Under this air pressure difference, dust and filth may enter into the dust barrel of the cleaner with the airflow through a nozzle and a air duct and then are filtered by the filter assembly, the grime may stay in the dust collection bag of the filter assembly, and the purified air is effused back to the room through the motor, by which the motor is chilled down and the air is purified.

To improve the cleaning efficiency against the ground, in addition to using the vacuum cleaning described above, a concave cavity is usually provided in the cleaner, and inside of which a roller brush is arranged. There are two objectives to arrange the roller brush, one is to increase the degree of vacuum in the dust suction port; the other is to slap against the ground so as to make the dust on the ground raised in the air, so that the raised dust is collected into the cleaner.

The detail will be shown in FIG. 1 and FIG. 2. FIG. 1 is a diagram of the local spatial structure of a conventional cleaner, and FIG. 2 is a cross-sectional view of a roller brush assembly of the conventional cleaner of FIG. 1. As shown in FIG. 1 and FIG. 2, the cleaner mainly consists of a housing 100 and a roller brush assembly 3, wherein the roller brush assembly 3 consists of a brush body 32 and multi-group tufting 311, the brush body 32 also has brush shafts 321, 321' thereon, and a synchronous pulley 33 on which a synchronous belt (not shown) is disposed is mounted on the brush shaft 321, and the synchronous belt is driven by the motor or other drive mechanism provided in the cleaner. The roller brush assembly 3 is disposed in a concave cavity 12 of the housing 100, and two ends of the roller brush assembly 3 are mounted on the end portions of the concave cavity 12 by means of bearing 35 which is disposed over the brush shaft 321'. A bearing rubber 34 is arranged on the end portion of the bearing 35, and a wool felt 36 of the roller brush and a felting retaining ring 37 are arranged on the end portion of the brush body 32. The multi-group tufting 311 are spirally arranged on the brush body 32. By the driving of the motor or other drive mechanism provided in the cleaner, the brush body 32 rotates at a high speed, such that the tufting 311 thereon may slap against the ground, by which the dust is raised in the air and easy to be collected into the cleaner. However, since there are always some soft materials, such as hair, thread of sewing, on the ground to be cleaned, especially on the floor of some families, and these soft materials may be prone to stick on the bristles of the roller brush, then move towards the ends of the roller brush while the brush is rotating, and finally get into the gap between the roller brush and the cleaner housing. In view of this, when there are too much of these soft materials in the gap between the roller brush and the cleaner housing, on the one hand, the flexibility of the brush shaft may be affected; on the other hand, these soft materials may get around the bearing and entangle the synchronous belt, which may also affect the flexibility of the brush shaft, such that, at least, the dust collection efficiency may be lowered and the burden of the driving mechanism (such as motors) may increase; to be severe, the brush shaft may get stuck or the synchronous belt may be tangled deadly so as to damage the shaft, motor and so on.

In addition to the above mentioned in FIG. 1 and FIG. 2 that the bristle brush in the prior art may be tangled in bearing, shaft or synchronous belt, likewise, the similar problem may also happen to the leather brush in the prior art. FIG. 3 is a cross-sectional view of a leather brush assembly of the ordinary cleaner in the prior art. The leather brush assembly includes a brush body 32 and brush leather facing 31; similar to the bristle brush, both ends of the brush body 32 are respectively provided with a bearing 35, a bearing rubber 34 and brush shafts 321 and 321', and a synchronous pulley 33 is disposed on the brush body 32 and connects with a driving mechanism (such as motor) provided in the cleaner via a synchronous belt (not shown). Because of the gap between the synchronous pulley 33 and brush body 32, most hair on the ground may tangle around the outer circular face of the roller brush and finally get the bearing, shaft stuck or the synchronous belt tangled deadly while the brush is conducting the rotation operation.

The situation described above not only happens to the cleaner, the same situation but also occurs to an independent part—the suction nozzle.

In view of the above problem, Chinese patent CN1768674A discloses a suction nozzle structure for preventing foreign object, such as hair, thread, from tangling the synchronous belt, as shown in FIG. 4 and FIG. 5, which provides a disc-shaped foreign object blocking plate 48 on one end of the roller brush that is near the synchronous belt. However, in the practical manufacturing, it is hard for foreign object blocking plate and the bottom housing of the suction nozzle to perfect match or be completely sealed with each other, there is still small space between foreign object blocking plate and the cleaner housing, foreign object, such as hair, still can tangle the synchronous belt through this space, and finally make the roller brush disabled.

SUMMARY OF THE INVENTION

For the technical problem to be solved by the present invention, it is based on the deficiencies in the prior art, and a vacuum cleaner and suction nozzle thereof are provided, so as to prevent soft materials such as hair, thread for sewing, from tangling the synchronous belt or jamming the bearing on the end portion of the roller brush or the shaft.

To settle the above technical problem, the present invention provides a vacuum cleaner comprising a housing, a dust collecting unit, a filter assembly, a motor assembly and a roller brush assembly;

The dust collecting unit, the filter assembly and the motor assembly are located in the housing, and the motor assembly is communicated with the dust collecting unit via the filter assembly;

the housing has a concave cavity communicating with outside, and the roller brush assembly is disposed in the concave cavity which communicates with the dust collecting unit via a duct; the roller brush assembly includes a roller bush including a brush part and a brush body, and the brush part is disposed on the brush body; end portions of the brush body connect to the housing via bearings, and a transmission component is arranged in the brush body which connects to a driving mechanism;

a separation piece is provided on a housing defining the concave cavity and the location of the separation piece corresponds to the transmission component, a fixed end of the separation piece is fixed on the housing and a free end thereof extends towards the longitudinal direction of the brush part, the free end of the separation piece at least reaches to a free end on the longitudinal direction of the brush part, such that a seamless and closed separation face is formed by a circular face formed while the roller brush is rotating in conjunction with the separation piece, so as to block foreign object out of the transmission component.

In addition, the present invention further provides a suction nozzle of vacuum cleaner, comprising a bottom housing, a front cover and a roller brush part, the bottom housing whose bottom is provided with a opening communicating with outside latches with the front cover to form a chamber, and the roller brush assembly is disposed inside the chamber; the roller brush assembly includes a roller bush including a brush part and a brush body, and the brush part is disposed on the brush body; end portions of the brush body are connected with the bottom housing via bearings, and the brush body is provided with a transmission component connecting to a driving mechanism;

a separation piece is provided on a housing defining the chamber and the location thereof corresponds to the transmission component, a fixed end of the separation piece is fixed on the housing and a free end thereof extends towards the longitudinal direction of the brush part, the free end of the separation piece at least reaches to a free end on the longitudinal direction of the brush part, such that a seamless and closed separation face is formed by a circular face formed while the roller brush is rotating in conjunction with the separation piece, so as to block foreign object away from the transmission component.

As for the vacuum cleaner and suction nozzle thereof provided in the present invention, while they are operating, a seamless and closed separation face is formed by a circular face formed while the roller brush is rotating in conjunction with the separation piece, which can effectively block soft materials, such as hair, thread for sewing, away from the gap between the transmission component of the roller brush and the housing, as well as the gap between the end portion of the roller brush and the housing, such that drawback such as the dust collection efficiency being lowered, damage of the components due to the tangled synchronous belt or jamming in shaft of the brush bearing can be avoided.

Hereinafter, the technical solution of the present invention will be described in detail with reference to the specific embodiments and the appended drawings.

DETAILED DESCRIPTION OF PREFERRED EMBODIMENTS

The First Embodiment

Figure 6:
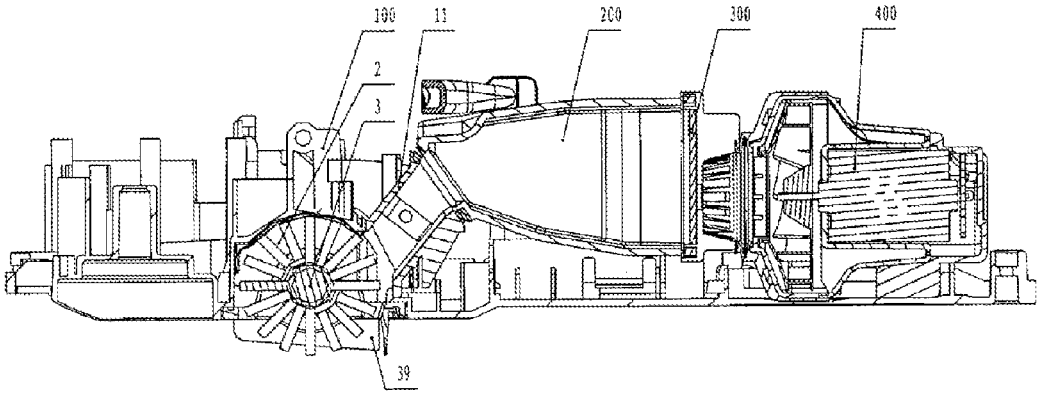
FIG. 6 is a side cross-sectional view of a vacuum cleaner of the first embodiment of the present invention.

As shown in FIG. 6, the present invention provides a vacuum cleaner, and FIG. 6 is a side cross-sectional view of the vacuum cleaner of the present invention. The vacuum cleaner in the embodiment comprises a housing 100, a dust collecting unit 200, a filter assembly 300, a motor assembly 400 and a roller brush assembly 3. The dust collecting unit 200, the filter assembly 300 and the motor assembly 400 are located in the housing 100. The motor assembly 400 is communicated with the dust collecting unit 200 via the filter assembly 300.

Figure 7:
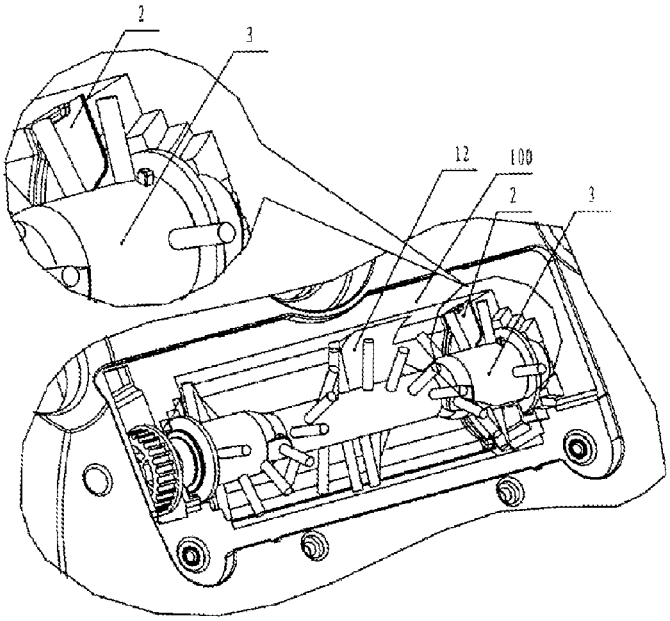
FIG. 7 is a diagram of the local spatial structure of the vacuum cleaner of the first embodiment of the present invention.
Figure 8:
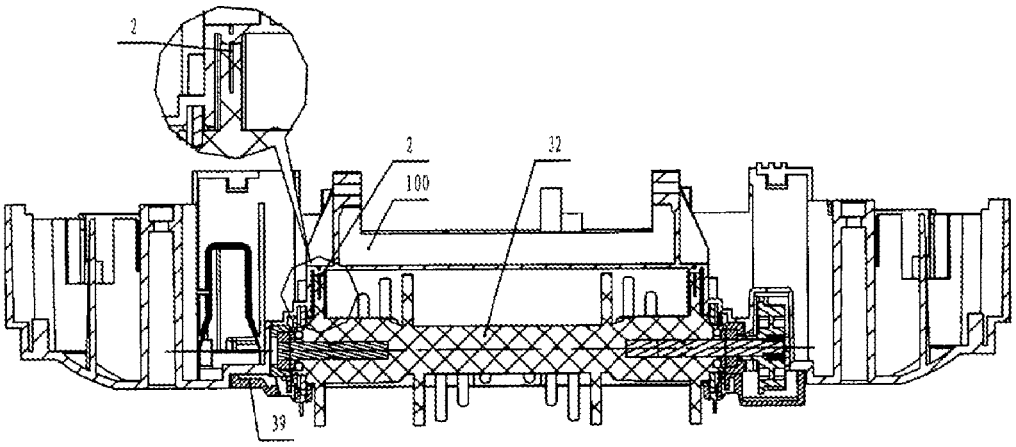
FIG. 8 is a partial cross-sectional view of the vacuum cleaner of the first embodiment of the present invention.

FIG. 7 is a diagram of the local spatial structure of the vacuum cleaner in the embodiment; FIG. 8 is a local cross-sectional view of the vacuum cleaner of the present invention. With reference of that shown in FIG. 6 to FIG. 8, the housing 100 is provided with a concave cavity 12 communicating with outside, and the roller brush assembly 300 is disposed in the concave cavity 12, such that a part of the roller brush assembly 300 is exposed to outside through an opening of the concave cavity 12, and the other part thereof is inserted into the concave cavity 12. A brush cover 39 is secured outside the concave cavity 12 by a fastener, such that the roller brush assembly 3 will not draw any large objects, such as pens, into the vacuum cleaner. The concave cavity 12 communicates with the dust collecting unit 200 via a duct 11. In the embodiment, the dust collecting unit 200 is a cylinder. In addition, the dust collecting unit 200 may also be in the form of the dust collection bag generally used by the vacuum cleaning products, such as a paper bag, a cloth bag and so on.

Figure 1:
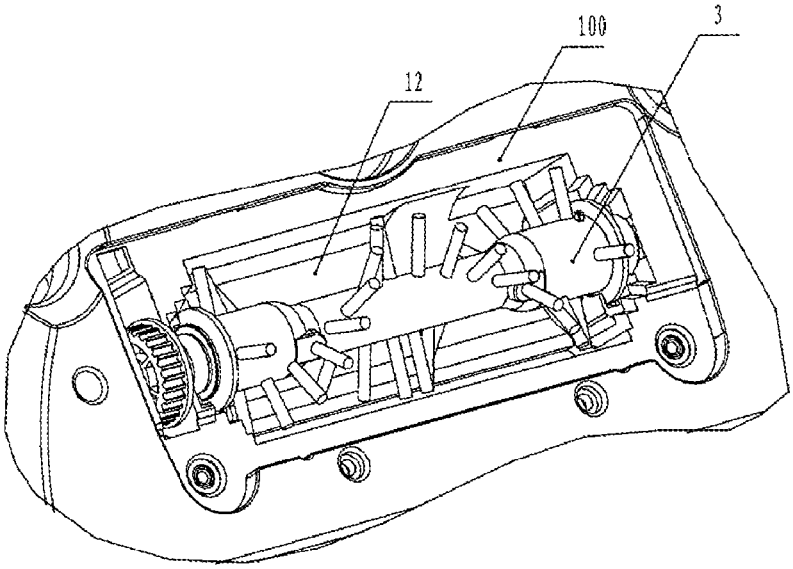
FIG.1 Prior Art
FIG. 1 is a diagram of the local spatial structure of an ordinary cleaner in the prior art.
Figure 2:
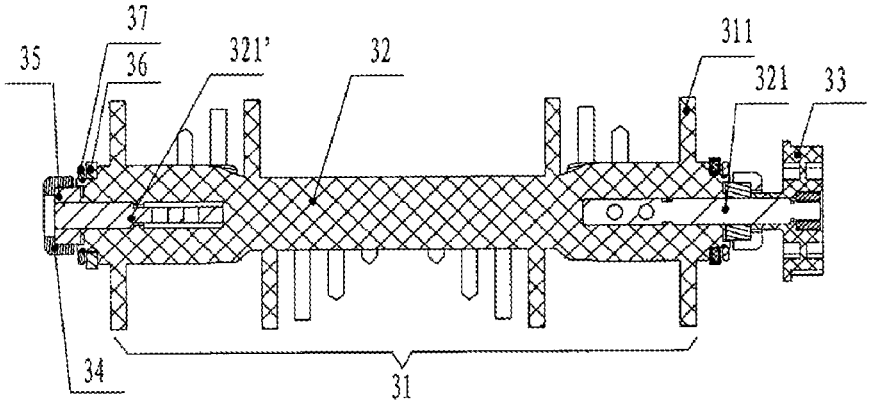
FIG.2 Prior Art
FIG. 2 is a cross-sectional view of a roller brush assembly of the ordinary cleaner of FIG. 1.
Figure 3:
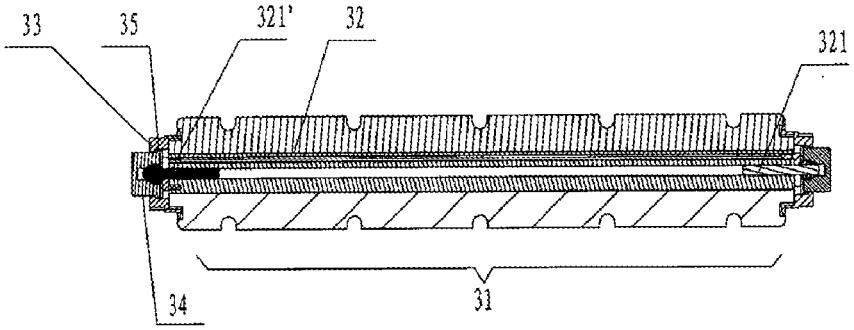
FIG.3 Prior Art
FIG. 3 is a cross-sectional view of a leather brush assembly of the ordinary cleaner in the prior art.

As shown in FIG. 7, the roller brush assembly 3 includes a roller bush 30 which includes a brush part 31 and a brush body 32, wherein one end of the brush part 31 is fixed at the brush body 32, which is referred to as a fixed end, and the other end thereof is a free end. The roller brush 30 in the embodiment uses the same roller brush with the prior art in FIG. 2, and the brush part 31 is bristle which is in form of multi-group tufting 311 spirally arranged on the brush body 32. In addition to the tufting-type roller brush used in the embodiment, a leather roller brush can also be used, e.g. the brush part 31 may be leather facing symmetrically arranged relative to the central axis of the roller brush body 32. With reference of that shown in FIG. 2, there are brush shafts 321 and 321' in both ends of the brush body 32, the brush shaft 321 in one end of the brush body 32 connects with the housing 100 via bearings 35. Meanwhile, the brush shaft 321 extends to connect with a synchronous pulley 33. The brush shaft 321' in the other end of the brush body 32 connects to the housing 100 via the bearing 35. The synchronous pulley 33 connects with the driving mechanism via a synchronous belt (not shown), wherein the synchronous pulley 33 and the synchronous belt together form a transmission component 320. The driving mechanism here is a motor disposed in the relevant position of the housing (not shown).

Figure 9:
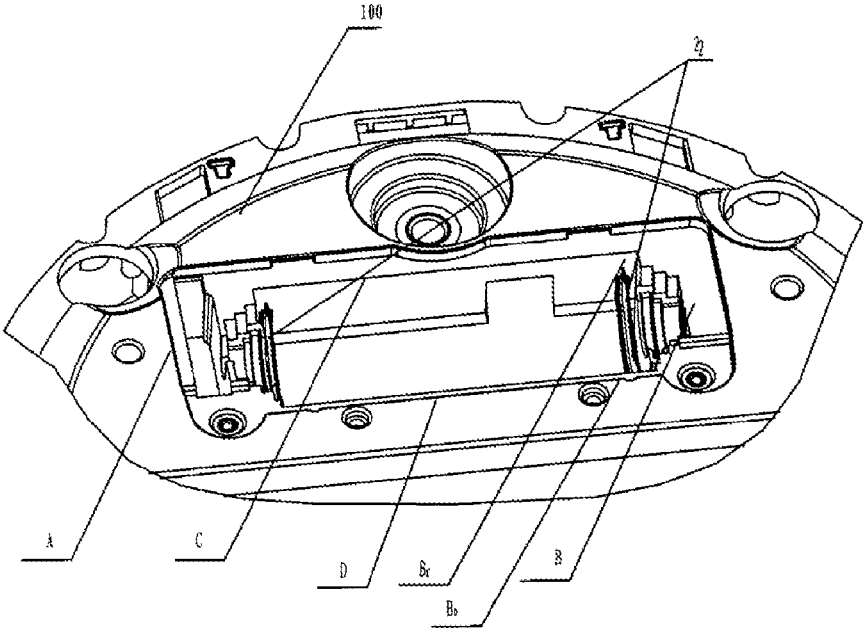
FIG. 9 is a schematic diagram of a suction nozzle of the vacuum cleaner of the first embodiment of the present invention with the roller brush assembly removed.
Figure 10:
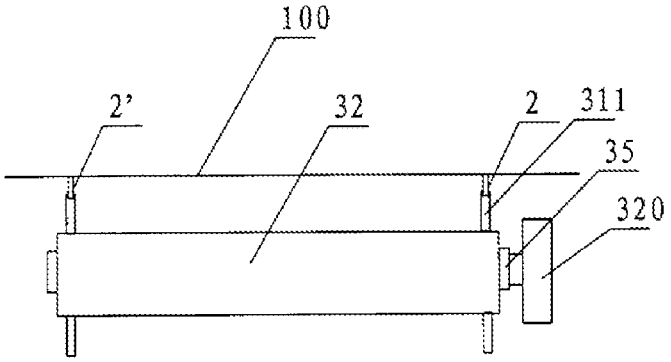
FIG. 10 is a diagram of a separation piece, a roller brush, a transmission component and so on of the first embodiment of the present invention.

FIG. 9 is a diagram of the vacuum cleaner of the present invention with the roller brush assembly removed. FIG. 10 is a diagram illustrating the relationship among a separation piece, the roller brush etc. in the first embodiment of the present invention. As shown in FIG. 9 and FIG. 10, at both end portions inside the concave cavity 12, separation pieces 2, 2' are provided on the housing which defines the concave cavity 12, specifically, the separation piece 2 is arranged at the housing defining the concave cavity 12 corresponding to inner side of the transmission component 320. In the present invention, said "inside/inner side" and "outside/outer side" are referring to a reference of the roller brush 30, the outside/outer side relates to the directions towards both ends of the roller brush 30, and the inside/inner side relates to the direction towards the middle area of the roller brush 30. Accordingly, with respect to the present invention, the transmission component 320, e.g. the synchronous pulley 33 and the synchronous belt, is located at the outer side of the bearing 35, and the separation piece 2 is disposed on the housing defining the concave cavity 12 corresponding to the tufting 311 inner side of the bearing 35. In the embodiment, there are two separation pieces 2 and 2', the separation piece 2 corresponding to the tufting 311 inner side of the bearing 35 on the right end portion of the brush body 32 is used to protect the synchronous belt in transmission component 320 as well as the bearing in the right end portion. The separation piece 2' corresponds to the tufting 311 inner side of the bearing 35 on the left end portion of the brush body 32, and it is for protecting the bearing in the left end portion.

Each separation piece has one fixed end and one free end, the fixed end is secured on the housing 100, and the free end thereof extends towards the longitudinal direction of the brush part 31. The free end of the separation piece at least reaches to a free end in the longitudinal direction of the brush body 31.

As shown in FIG. 9, the opening of the concave cavity 12 against the housing 100 is substantially formed as a rectangle, four sides of which respectively are A, B, C, D, wherein sides A, B and sides C, D are two sets of opposite sides, the end where side A is located is End A, and the end where side B is located is End B, one end of End B is referenced as BC, and the other end of End B is referenced as BD, likewise, one end of End A is referenced as AC, and the other end of End A is referenced as AD. The separation piece 2 located in End B extends at the fixed end inside the concave cavity 12 from said one end BC of End B in the opening of the concave cavity 12 to the other end BD. At the fixed end inside the concave cavity 12, the separation piece 2 located in End A extends from said one end AC of End A in the opening of the concave cavity 12 to the other end AD.

The driving mechanism drives the synchronous belt, by means of the synchronous belt the roller brush 30 is further driven with high speed rotation and the tufting 311 on the roller brush 30 also rotates at high velocity, such that the rotating roller brush 30 forms a circular face. As the free end of the separation piece 2 extends towards the longitudinal direction of the brush bristle 31, which means the cross-section of the separation piece 2 is tangent to that of the tufting 311 and perpendicular to the axis of the brush body 32. Moreover, the free end of the separation piece 2 at least reaches to the free end in the longitudinal direction of the brush bristle 31, that is, the free end of the separation piece 2 at least reaches to the free end of the tufting 311 or inserts into the tufting 311 as shown in FIG. 8. Accordingly, a seamless and closed separation face is formed by the circular face formed while the roller brush is rotating in conjunction with the separation piece 2, such that foreign object, such as hair, can be completely blocked out of this closed face and impossible to move towards the synchronous belt at one end of the roller brush and the bearing at the other end, which can finally avoid the tangled synchronous belt and jamming to the bearing and shaft of the roller brush.

In the embodiment, the closed face can be formed when the free end of the separation piece 2 right reaches to the terminal of the brush bristle 31, preferably, the free end of the separation piece 2 may be inserted into the tufting with a certain length, such that foreign object, such as hair, can be desirably blocked by the separation piece 2 and impossible to move towards both ends of the roller brush along free end of the bristle.

Here in the embodiment, housing of both ends in the concave cavity 12 is respectively provided with one separation piece 2, whose location in the housing 100 corresponds to the first group tufting 311 on the periphery of the end portion of the roller brush body 32. As it should be, it is also feasible to make the separation piece 2 correspond to the bristle on the periphery of the end portion of the brush body if the roller brush 30 employs other types of structure.

The location arrangement of the separation piece 2 described above is merely for exemplary, but is not limited to so. For example, the arranged location of separation piece 2 may either correspond to the bristle 31 on the periphery of the end portion of the brush body 32, or to the bristle having appropriate distance away from the end portion of the brush body 32. Taking the structure of the roller brush shown in FIG. 8 for example, the arranged location of separation piece 2 may correspond to the first group tufting on the end portion of the brush body 32 that is inner side of the bearing, or it may also correspond to the second or third group tufting from the end portion.

In the above embodiment, the number of the separation piece arranged at one end of the concave cavity 12 is one, but it can also be a plurality. If a plurality of separation pieces are provided, each separation piece may correspond to a certain amount of bristle and extends towards the longitudinal direction of the brush bristle. The blocking effect to soft materials, such as hair, may be well enhanced when a plurality of separation pieces are provided.

Figure 13:
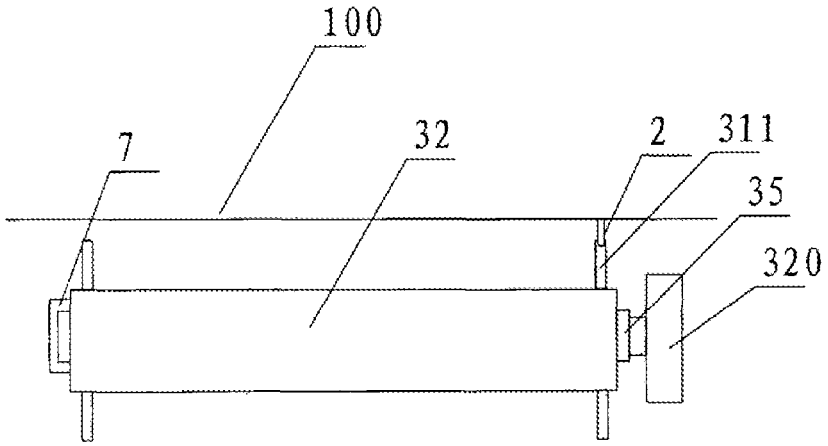
FIG. 13 is a diagram of the separation piece, the roller brush, the transmission component and so on of another embodiment of the present invention.

In the embodiment, the separation pieces 2 are disposed on both ends of the concave cavity 12. In addition, the separation piece may be merely on the end where the transmission component is provided, as shown in FIG. 13, while at the other end sealing protection is performed to the bearing thereon by equipping a bearing cap 7 outer side of the bearing.

Figure 14:
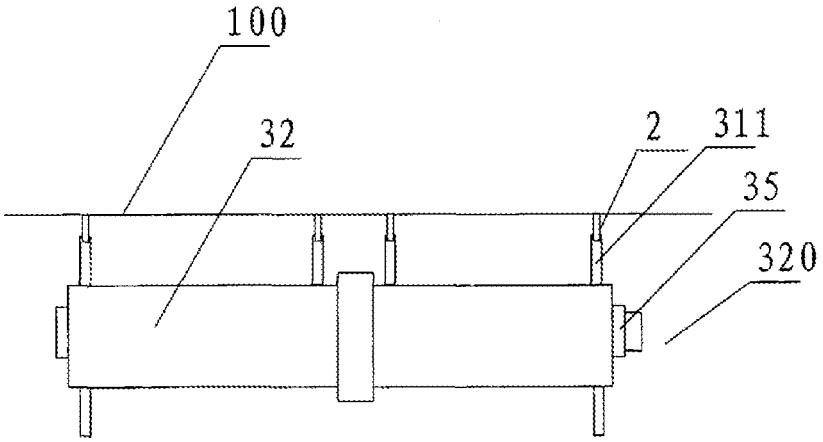
FIG. 14 is a diagram of the separation piece, the roller brush, the transmission component and so on of yet another embodiment of the present invention.

When the transmission component provided in the roller brush is arranged at the middle area thereof, while as shown in FIG. 14 two sides of the roller brush are connected with each other merely by means of the bearing and the housing. With respect to such structure, relative to both sides of the transmission component, each separation piece is respectively provided to the housing so as to protect the synchronous belts. Preferable, relative to both ends of the roller brush, each separation piece is respectively provided to the housing again so as to protect the bearing, in this case, there are four separation pieces in this structure. As it should be, if a bearing cap is equipped outer side of the bearing in both ends of the roller brush, separation pieces are not necessary to be provided at the ends, and only two separation pieces are enough for such structure.

Figure 11:
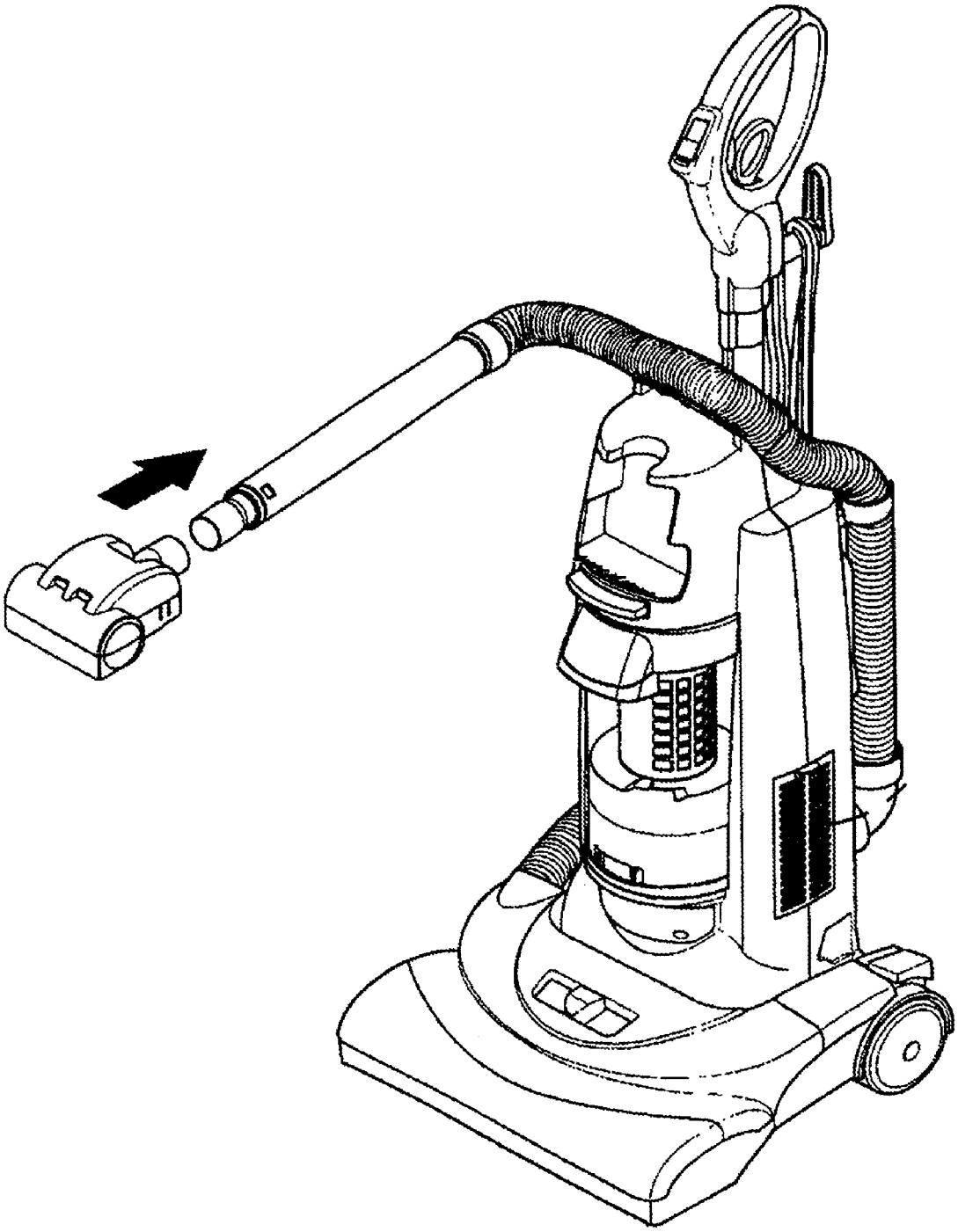
FIG. 11 is a diagram of the spatial structure of the vacuum cleaner of another specific embodiment of the present invention.

The vacuum cleaner described in the present invention is a horizontal cleaner, and as it should be, the present technical solution can be also used in type of upright cleaner. FIG. 11 is a diagram of the spatial structure of the vacuum cleaner of another specific embodiment, and this vacuum cleaner therein is an upright cleaner.

As the shape and size of the vacuum cleaner may be varied in terms of needs, the present invention merely specifically exemplifies the key components relative to the corresponding location of the roller brush assembly in the vacuum cleaner, with respect to the shape of the vacuum cleaner as well as the transmission component of the roller brush, in terms of practical demand, ones skilled in the art may perform them with reference of the prior art.

In addition, the fixing structure described above between the separation piece 2 and the housing inside the concave cavity 12 may use any structures in the prior art, e.g. forming the separation piece 2 and the housing into one piece, using the structure of groove and snap, by means of intermediate component or using structure like bolt, screw and so on. Meanwhile, since friction is generated between the separation piece 2 and the brush bristle while the brush bristle is rotating, the separation piece 2 in the present invention accordingly is made of some rigid and wear-resistant materials, such as steel, POM and other materials.

The Second Embodiment

Figure 4:
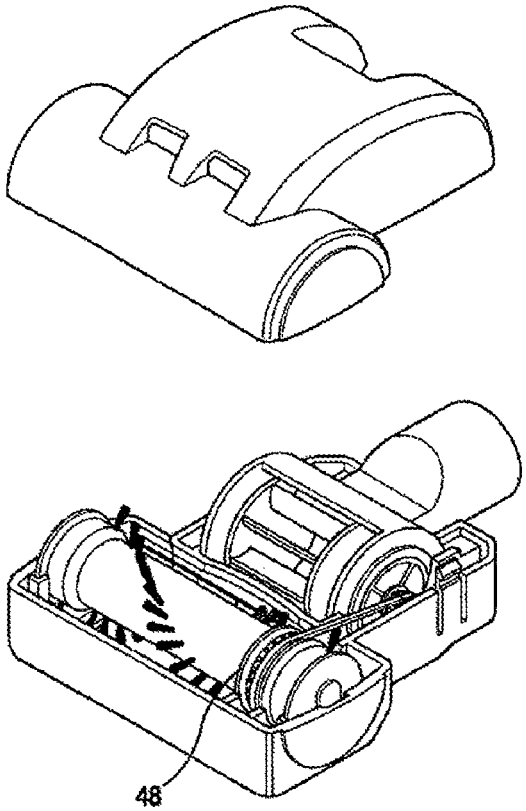
FIG.4 Prior Art
FIG. 4 is a diagram of the spatial structure of a suction nozzle in the prior art having a foreign object blocking plate.
Figure 5:
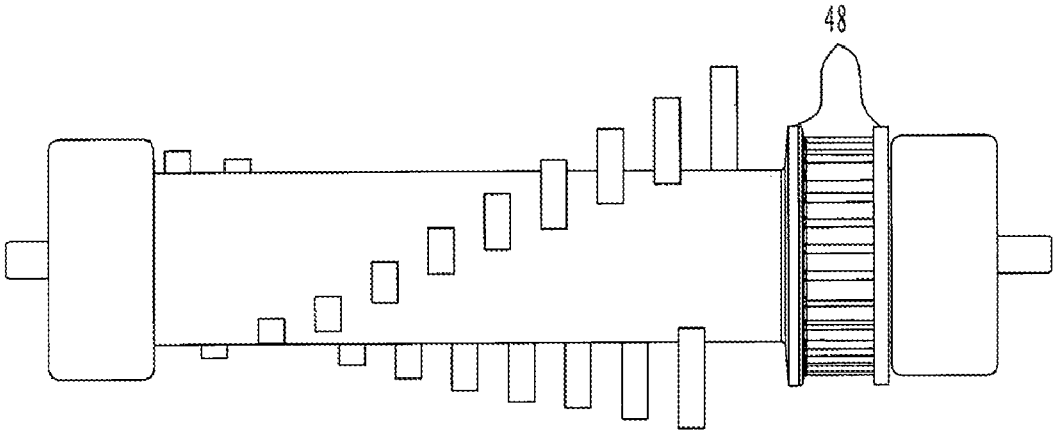
FIG.5 Prior Art
FIG. 5 is a diagram of the structure of the roller brush assembly of FIG. 4.
Figure 12A:
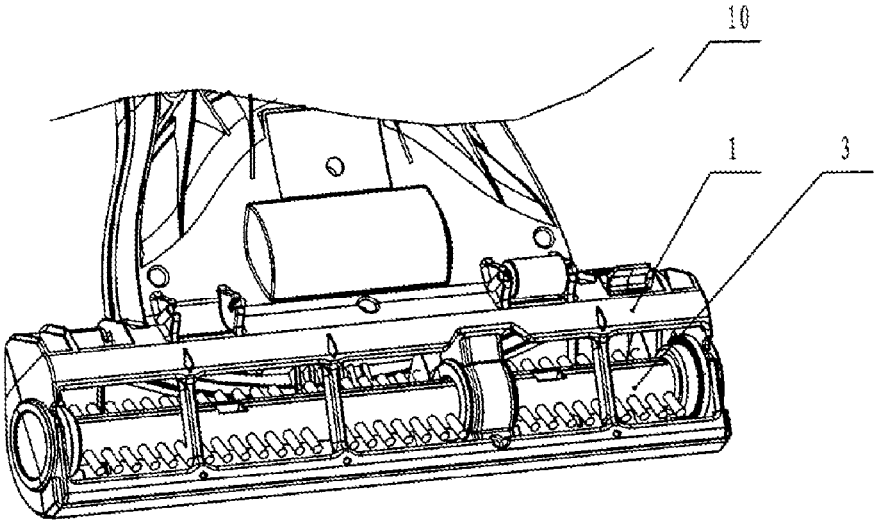
FIG. 12A is a partial perspective of the suction nozzle of the vacuum cleaner of the second embodiment of the present invention.
Figure 12B:
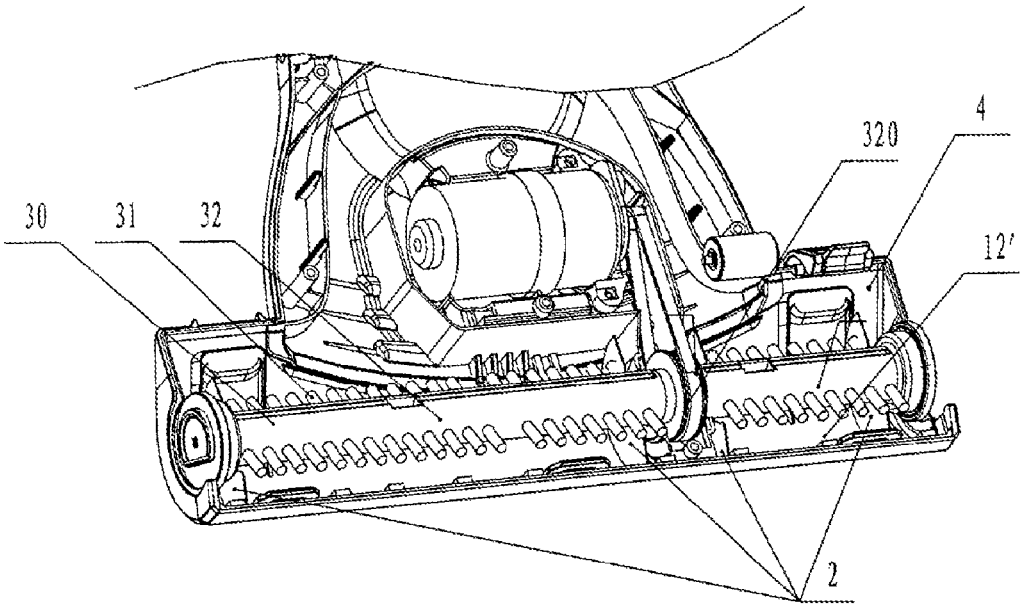
FIG. 12B is a partial perspective of the suction nozzle of the vacuum cleaner of the second embodiment of the present invention with bottom housing removed.

This embodiment refers to a suction nozzle of the vacuum cleaner. FIG. 12A is a partial perspective of the suction nozzle of the vacuum cleaner in the present invention; FIG. 12B is a partial perspective of the suction nozzle of the vacuum cleaner in the present invention with the bottom housing removed. As shown in FIG. 12A and FIG. 12B, the present invention provides a suction nozzle 10 of the vacuum cleaner, comprising a bottom housing 1, a front cover 4 and a roller brush part 3, the bottom housing 1 with a opening communicating with outside arranged in the bottom thereof latches with the front cover 4 to form a chamber 12', and the roller brush assembly 3 and a driving mechanism are disposed inside the chamber 12'. The driving mechanism may be a motor, and it also could be a rotating turbine as used in FIG. 4. The roller brush assembly 3 includes a roller bush 30 which includes a brush part 31 and a brush body 32, and the brush part 31 is disposed on the brush body 32; the end portions of the brush body 32 is connected with the bottom housing 1 via bearings, and the brush body 32 is provided with a transmission component 320, a separation piece 2 is provided on the housing defining the chamber 12' where the transmission component 320 and the driving mechanism are connected. In the embodiment, the roller brush assembly 3, the locations of the separation piece 2 in the housing, the structure like the transmission component may be the same as the cases in the first embodiment, and the chamber 12' is equivalent to the concave cavity 12 in the first embodiment and will not be described here.

Since the other structures of the vacuum cleaner in the present invention may employ any kind of technique in the prior art, here will not be described.

By means of the vacuum cleaner or the vacuum suction nozzle of the present invention, it can effectively block soft foreign object, such as hair, thread, away from the gap between the transmission component of the roller brush and the housing, as well as the gap between the end portion of the roller brush and the housing, such that drawback such as the dust collection efficiency being lowered, damage of the components due to the tangled synchronous belt or brush shaft can be avoided.

The invention claimed is:

1. A vacuum cleaner, comprising:

a housing, a dust collecting unit, a filter assembly, a motor assembly and a roller brush assembly, wherein the dust collecting unit, the filter assembly and the motor assembly are located in the housing, and the motor assembly is communicated with the dust collecting unit via the filter assembly, the housing has a concave cavity communicating with an outside, and the roller brush assembly is disposed in the concave cavity which communicates with the dust collecting unit via a duct;

the roller brush assembly comprises a roller brush including a brush body and a brush part disposed on the brush body, the brush part comprising at least one bristle tuft extending radially from the brush body, the at least one bristle tuft having a free end for contacting a floor surface during cleaning;

end portions of the brush body connect with the housing via bearings, and a transmission component is arranged on the brush body which connects to a driving mechanism;

a separation piece is provided on the housing defining the concave cavity and is located at a side of the transmission component;

the separation piece has a fixed end fixed on the housing and a free end that extends towards the longitudinal direction of the brush part;

the fixed end of the separation piece extends, inside the concave cavity along a rotation direction of the roller brush, from a front side of an opening of the concave cavity to a rear side of the opening of the concave cavity in a direction generally perpendicular to a longitudinal axis of the roller body; and the free end of the separation piece is substantially aligned with at least one bristle tuft of the roller brush and at least reaches to a free end in the longitudinal direction of the at least one substantially aligned bristle tuft such that when the roller brush is in high speed rotation, the at least one substantially aligned bristle tuft brush part is periodically rotated into contact with the free end of the separation piece and, in conjunction with the separation piece, blocks foreign objects out of the transmission component.

2. The vacuum cleaner of claim 1, wherein the transmission component is located at a middle area of the brush body, the separation piece is among two separation pieces included in the vacuum, and the two separation pieces each reach at least one bristle tuft of the roller brush located on both respective sides of the transmission component.

3. The vacuum cleaner of claim 2, wherein a bearing is located at the one end of the brush body, and on the housing defining the concave cavity, another separation piece is provided at a side of the bearing that is oriented toward the transmission component.

4. The vacuum cleaner of claim 1, wherein the transmission component is located at one end of the brush body, and the separation piece is located at a side of the transmission component that is oriented toward a middle of the brush body.

5. The vacuum cleaner of claim 4, wherein a bearing is located at the one end of the brush body, the transmission component is located at a side of the bearing that is oriented away from the brush body, and the separation piece is located at a side of the bearing that is oriented toward the middle of the brush body.

6. The vacuum cleaner of claim 4, wherein a bearing is located at the second end of the brush body, and on the housing defining the concave cavity, another separation piece is provided at a side of the bearing that is oriented toward the middle of the brush body.

7. The vacuum cleaner of claim 1, wherein the separation piece is a first separation piece arranged at one end of the concave cavity, and the vacuum cleaner comprises a second separation piece arranged at another end of the concave cavity, and each of the first and second separation pieces extends towards the brush body.

8. The vacuum cleaner of claim 1, wherein the at least one bristle tuft comprises multi-group tufting spirally arranged on the brush body.

9. A suction nozzle of a vacuum cleaner, comprising:

a bottom housing, a front cover and a roller brush part, wherein the bottom housing, whose bottom is provided with an opening communicating with an outside, latches with the front cover to form a chamber, and the roller brush assembly is disposed inside the chamber;

the roller brush assembly comprises a roller brush including a brush body and a brush part disposed on the brush body the brush part comprising at least one bristle tuft extending radially from the brush body, the at least one bristle tuft having a free end that extends out of the chamber during rotation for contacting a floor surface during cleaning;

end portions of the brush body are connected with the bottom housing via bearings, and the brush body is provided with a transmission component connecting to a driving mechanism;

a separation piece is provided on the housing defining the chamber, and is located at a side of the transmission component;

the separation piece has a fixed end fixed on the housing and a tree end that extends towards the longitudinal direction of the brush part;

the fixed end of the separation piece extends, inside the chamber along a rotation direction of the roller brush, from a front side of an opening of the chamber to a rear side of the opening of the chamber in a direction generally perpendicular to a longitudinal axis of the roller body; and the free end of the separation piece is substantially aligned with at least one bristle tuft of the roller brush and at least reaches to a free end in the longitudinal direction of the at least one substantially aligned bristle tuft such that when the roller brush is rotating, the at least one substantially aligned bristle tuft is periodically rotated into contact with the free end of the separation piece and, in conjunction with the separation piece, block foreign objects away from the transmission component.

10. The suction nozzle according to claim 9, wherein the transmission component is located at a middle area of the brush body, the separation piece is among two separation pieces included in the suction nozzle, and the two separation pieces each reach at least one bristle tuft of the roller brush located on both respective sides of the transmission component.

11. The suction nozzle according to claim 9, wherein the transmission component is located at one end of the brush body, and the separation piece is located at a side of the transmission component that is oriented toward a center of the brush body.

12. The suction nozzle according to claim 11, wherein a bearing is located at the one end of the brush body, the transmission component is located at a side of the bearing that is oriented away from the brush body, and the separation piece is located at a side of the bearing that is oriented toward a middle of the brush body.

13. The suction nozzle according to claim 9, wherein a bearing is located at an end of the brush body, and on the housing defining the chamber, another separation piece is provided at a side of the bearing that is oriented toward the middle of the brush body.

14. The suction nozzle according to claim 9, wherein the separation piece is a first separation piece arranged at one end of the chamber, and the vacuum cleaner comprises a second separation piece arranged at another end of the chamber, and each of the first and second separation pieces extends towards the brush body.

15. The vacuum cleaner of claim 9, wherein the at least one bristle tuft comprises a multi-group tufting spirally arranged on the brush body.

* * * * *